US011540368B1

(12) United States Patent
Chen

(10) Patent No.: US 11,540,368 B1
(45) Date of Patent: Dec. 27, 2022

(54) COLOR TEMPERATURE AND BRIGHTNESS CONTROL SYSTEM FOR LED LAMP

(71) Applicant: AIR COOL INDUSTRIAL CO., LTD., Taichung (TW)

(72) Inventor: Shih-Ming Chen, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 17/479,716

(22) Filed: Sep. 20, 2021

(51) Int. Cl.

| | |
|---|---|
| ***H05B 45/24*** | (2020.01) |
| ***H05B 45/10*** | (2020.01) |
| ***F21V 23/04*** | (2006.01) |
| ***F21V 23/00*** | (2015.01) |
| ***F21Y 115/10*** | (2016.01) |

(52) U.S. Cl.
CPC ..... *H05B 45/24* (2020.01); *F21V 23/003* (2013.01); *F21V 23/04* (2013.01); *H05B 45/10* (2020.01); *F21Y 2115/10* (2016.08)

(58) Field of Classification Search
CPC ..... H05B 45/24; H05B 45/10; F21V 23/003; F21V 23/04; F21Y 2115/10
See application file for complete search history.

(56) References Cited

U.S. PATENT DOCUMENTS

| | | | | |
|---|---|---|---|---|
| 2018/0231240 | A1* | 8/2018 | Roca | F21V 23/045 |
| 2019/0098723 | A1* | 3/2019 | Sadwick | F21K 9/272 |
| 2020/0067343 | A1* | 2/2020 | Chen | F21V 17/02 |

* cited by examiner

*Primary Examiner* — Andrew J Coughlin
*Assistant Examiner* — Jessica M Apenteng
(74) *Attorney, Agent, or Firm* — Pai Patent & Trademark Law Firm; Chao-Chang David Pai

(57) ABSTRACT

A color temperature and brightness control system for an LED lamp of a ceiling fan includes a switch, a detection module, a determining module, a memory module, a control module, and a drive unit. The detection module detects the actuation of the switch, and the determining module performs a comparison. The control module outputs a control signal to the drive unit according to the calculation result of the determining module and the memory module to drive the lamp to actuate. The color temperature and brightness control system is able to control the lamp to be turned on/off and the brightness and color temperature of the lamp through a single switch.

9 Claims, 5 Drawing Sheets

COLOR TEMPERATURE AND BRIGHTNESS CONTROL SYSTEM FOR LED LAMP

FIELD OF THE INVENTION

The present invention relates to a ceiling fan, and more particularly to a color temperature and brightness control system for an LED lamp of a ceiling fan.

BACKGROUND OF THE INVENTION

A conventional ceiling fan is provided with a lamp. The lamp is electrically connected to a controller. The controller is operated by a pull cord switch to control the lamp to be turned on/off. The on/off, brightness and color temperature of the lamp cannot be controlled through a single switch. Accordingly, the inventor of the present invention has devoted himself based on his many years of practical experiences to solve these problems.

SUMMARY OF THE INVENTION

The primary object of the present invention is to provide a color temperature and brightness control system for an LED lamp, which is able to control the lamp to be turned on/off and the brightness and color temperature of the lamp through a single switch.

In order to achieve the aforesaid object, the present invention provides a color temperature and brightness control system for an LED lamp, applied to a ceiling fan. The ceiling fan has a lamp. The lamp is an LED lamp. The color temperature and brightness control system comprises a switch, a detection module, a determining module, a memory module, a control module, and a drive unit. The switch has a switch signal. When the switch is not actuated, the switch signal has a normal potential. When the switch is actuated, the switch signal has an actuation potential. The detection module is electrically connected to the switch. The detection module receives the switch signal and detects a duration of the actuation potential and a duration of the normal potential of the switch signal to output a detection signal. The determining module is configured to receive the detection signal and determines the duration of the actuation potential to output a determination signal. The memory module is configured to memorize a state of the lamp. The memory module outputs a lamp state signal. The lamp state signal includes the state of the lamp. The state of the lamp includes an on/off state, a color temperature state and a brightness state of the lamp. The control module is in signal communication with the determining module. The control module receives the determination signal. The determining module and the control module are in signal communication with the memory module for the memory module to store the state of the lamp so that the control module receives the lamp state signal. The control module outputs a control signal according to a calculation result of the determination signal and the lamp state signal. The control signal is used for an on/off control, a color temperature control and a brightness control of the lamp. The drive unit is electrically connected to the lamp and the control module. The drive unit receives the control signal of the control module to output a drive signal for driving the lamp to be actuated.

The color temperature and brightness control system provided by the present invention is able to control the lamp to be turned on/off and the brightness and color temperature of the lamp through a single switch.

DETAILED DESCRIPTION OF THE PREFERRED EMBODIMENTS

Embodiments of the present invention will now be described, by way of example only, with reference to the accompanying drawings.

Figure 1:
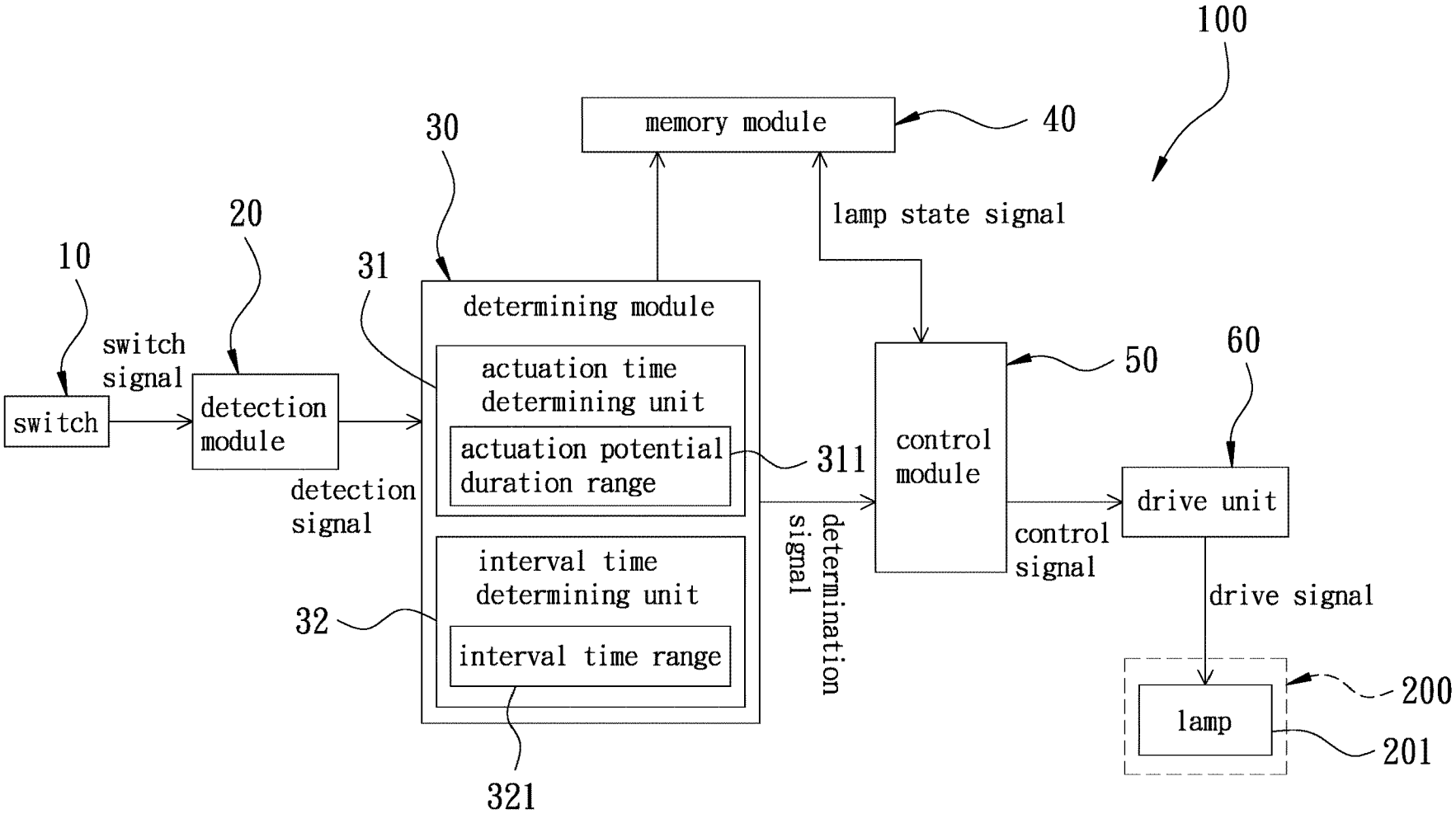
FIG. 1 is a block diagram of the present invention.
Figure 2:
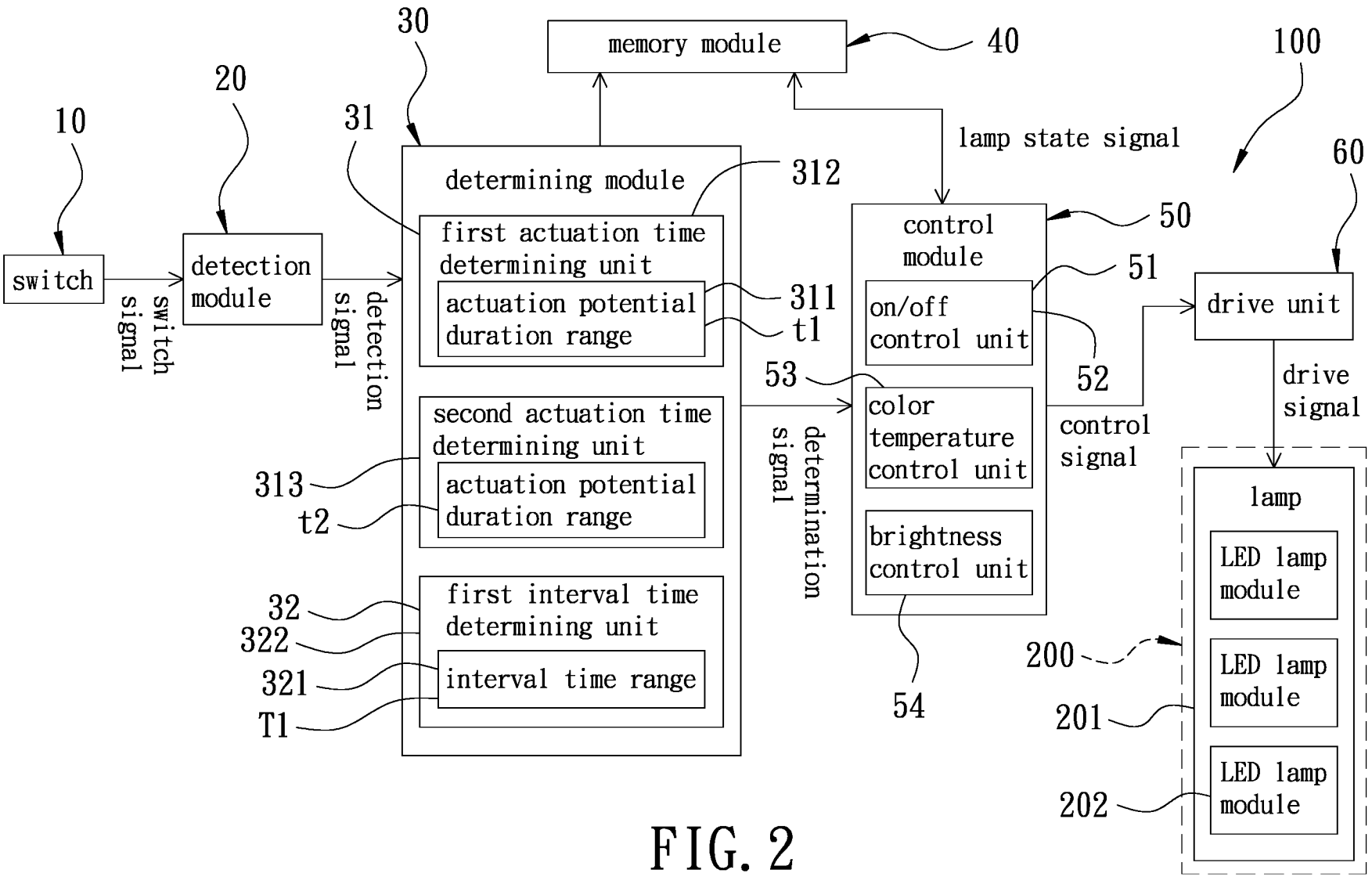
FIG. 2 is a block diagram of a first embodiment of the present invention.

FIG. 1 is a block diagram of the present invention. FIG. 2 is a block diagram of a first embodiment of the present invention. The present invention discloses a color temperature and brightness control system 100 for an LED lamp, applied to a ceiling fan 200. The ceiling fan 200 is electrically connected to a power source. The connection of the power source is omitted in the figures. The ceiling fan 200 has a lamp 201. The lamp 201 is an LED lamp. In the first embodiment of the present invention, the lamp 201 has at least two sets of LED lamp modules 202 with different color temperatures. The color temperature and brightness control system 100 comprises a switch 10, a detection module 20, a determining module 30, a memory module 40, a control module 50, and a drive unit 60.

Figure 3:
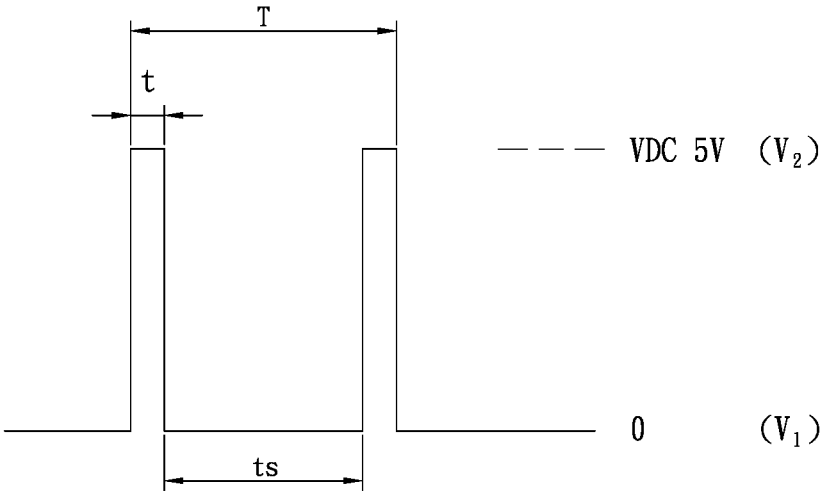
FIG. 3 is a reference diagram of the waveform state of the switch signal of the present invention, taking a normally open switch as an example.
Figure 4:
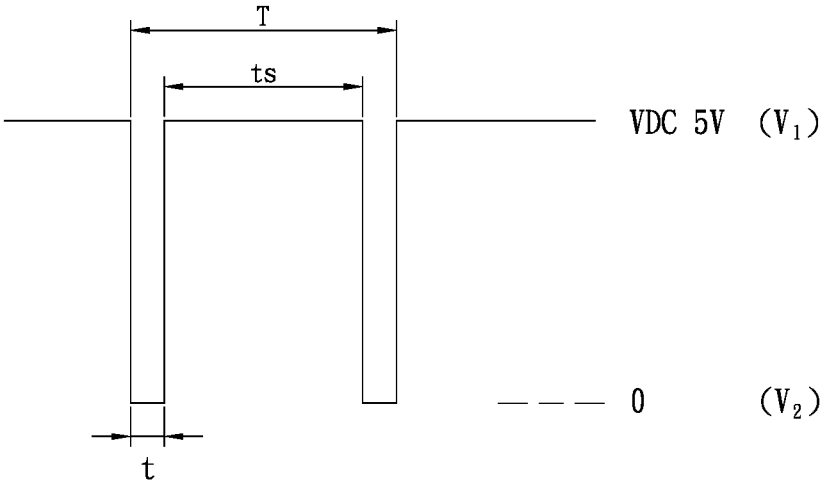
FIG. 4 is a reference diagram of the waveform state of the switch signal of the present invention, taking a normally closed switch as an example.

The switch 10 has a switch signal. When the switch 10 is not actuated, the potential of the switch signal is a normal potential V1. When the switch 10 is actuated, the potential of the switch signal is an actuation potential V2. The switch 10 may be a normally open switch or a normally closed switch, as shown in FIG. 3 and FIG. 4. FIG. 3 shows a normally open switch as an example. FIG. 4 shows a normally closed switch as an example.

The detection module 20 is electrically connected to the switch 10 and receives the switch signal. The detection module 20 detects the duration t of the actuation potential V2 and the duration ts of the normal potential V1 of the switch signal to output a detection signal.

The determining module 30 receives the detection signal, determines the duration t of the actuation potential V2, and determines a combination of the duration t of the actuation potential V2 and the duration ts of the normal potential V1 to output a determination signal. The determining module 30 has at least one actuation time determining unit 31 and at least one interval time determining unit 32. The actuation time determining unit 31 and the interval time determining unit 32 of the determining module 30 are in signal communication with the detection module 20 and receive the detection signal. Each actuation time determining unit 31 presets an actuation potential duration range 311, and compares the duration t of the actuation potential V2 with the actuation potential duration range 311 of the actuation time determining unit 31. Each interval time determining unit 32 presets an interval time range 321, and compares an interval time between two adjacent actuation potentials V2 and the interval time range 321 of the interval time determining unit 32. The determining module 30 outputs the determination signal. The determination signal includes the comparison result of the actuation time determining unit 31 of the determining module 30 and the comparison result of the actuation time determining unit 31 and the interval time determining unit 32. The at least one actuation time determining unit 31 has two actuation time determining units 31, defined as a first actuation time determining unit 312 and a second actuation time determining unit 313. The at least one interval time determining unit 32 has one interval time determining unit 32, defined as a first interval time determining unit 322. The actuation potential duration ranges 311 of the actuation time determining units 31 do not overlap with each other. In the first embodiment of the present invention, the actuation potential duration range t1 of the first actuation time determining unit 312 is t1<2 s. The actuation potential duration range t2 of the second actuation time determining unit 313 is 2 s<t2. The interval time range T1 of the first interval time determining unit 322 is T1<2 s, where the unit of s is seconds. The interval time T between the two adjacent actuation potentials V2 may be the sum of the duration t of the two adjacent actuation potentials V2 and the duration ts of the normal potential V1 between the two adjacent actuation potentials V2, or the duration ts of the normal potential V1 between the two adjacent actuation potentials V2.

The memory module 40 is configured to memorize the state of the lamp 201 and output a lamp state signal. The lamp state signal includes the state of the lamp 201. The state of the lamp 201 includes the on/off state, color temperature state, and brightness state of the lamp 201.

The control module 50 is in signal communication with the actuation time determining unit 31 and the interval time determining unit 32 of the determining module 30, and receives the determination signal. The determining module 30 and the control module 50 are in signal communication with the memory module 40 for the memory module 40 to store the state of the lamp 201, so that the control module 50 receives the lamp state signal. The control module 50 outputs a control signal according to the calculation result of the determination signal and the lamp state signal. The calculation result of the determination signal and the lamp state signal is at least one of the calculation result of the actuation time determining unit 31 of the determining module 30 and the state of the lamp 201 of the memory module 40 and the calculation result of the actuation time determining unit 31, the interval time determining unit 32, and the state of the lamp 201 of the memory module 40. The control signal is used for the on/off control, color temperature control and brightness control of the lamp 201. The control module 50 further has three control units 51, defined as an on/off control unit 52, a color temperature control unit 53, and a brightness control unit 54. The on/off control unit 52 outputs the control signal according to the comparison result of the first actuation time determining unit 312 and the on/off state of the lamp of the memory module 40 for controlling the lamp 201 to be turned on/off. The color temperature control unit 53 outputs the control signal according to the comparison result of the first actuation time determining unit 312 and the first interval time determining unit 322 and the color temperature state of the lamp of the memory module 40. The color temperature control unit 53 outputs the control signal to control each LED lamp module 202 to be turned on/off for controlling the color temperature of the lamp 201. The brightness control unit 54 outputs the control signal according to the comparison result of the second actuation time determining unit 313 and the brightness state of the lamp of the memory module 40 for controlling the brightness of the lamp 201. The brightness control unit 54 further controls the brightness of the lamp 201 incrementally according to the duration t of the actuation potential V2. The control module 50 is electrically connected to the power source. The connection of the power source is omitted in the figures.

The drive unit 60 is electrically connected to the lamp 201 and the control module 50. The drive unit 60 receives the control signal of the control module 50 to output a drive signal for driving the lamp 201 to be actuated.

The user operates the switch 10. The duration t of the actuation potential V2 of the switch signal and the duration is of the normal potential V1 selectively meet the conditions of the aforementioned preset actuation potential duration range t1 of the first actuation time determining unit 312, the actuation potential duration range t2 of the second actuation time determining unit 313, the interval time range T1 of the first interval time determining unit 322. The on/off control unit 52, the color temperature control unit 53 and the brightness control unit 54 of the control module 50 outputs the control signal to the drive unit 60 according to the met conditions for driving the lamp 201 to be turned on/off and for controlling the brightness and color temperature of the lamp 201.

Figure 5:
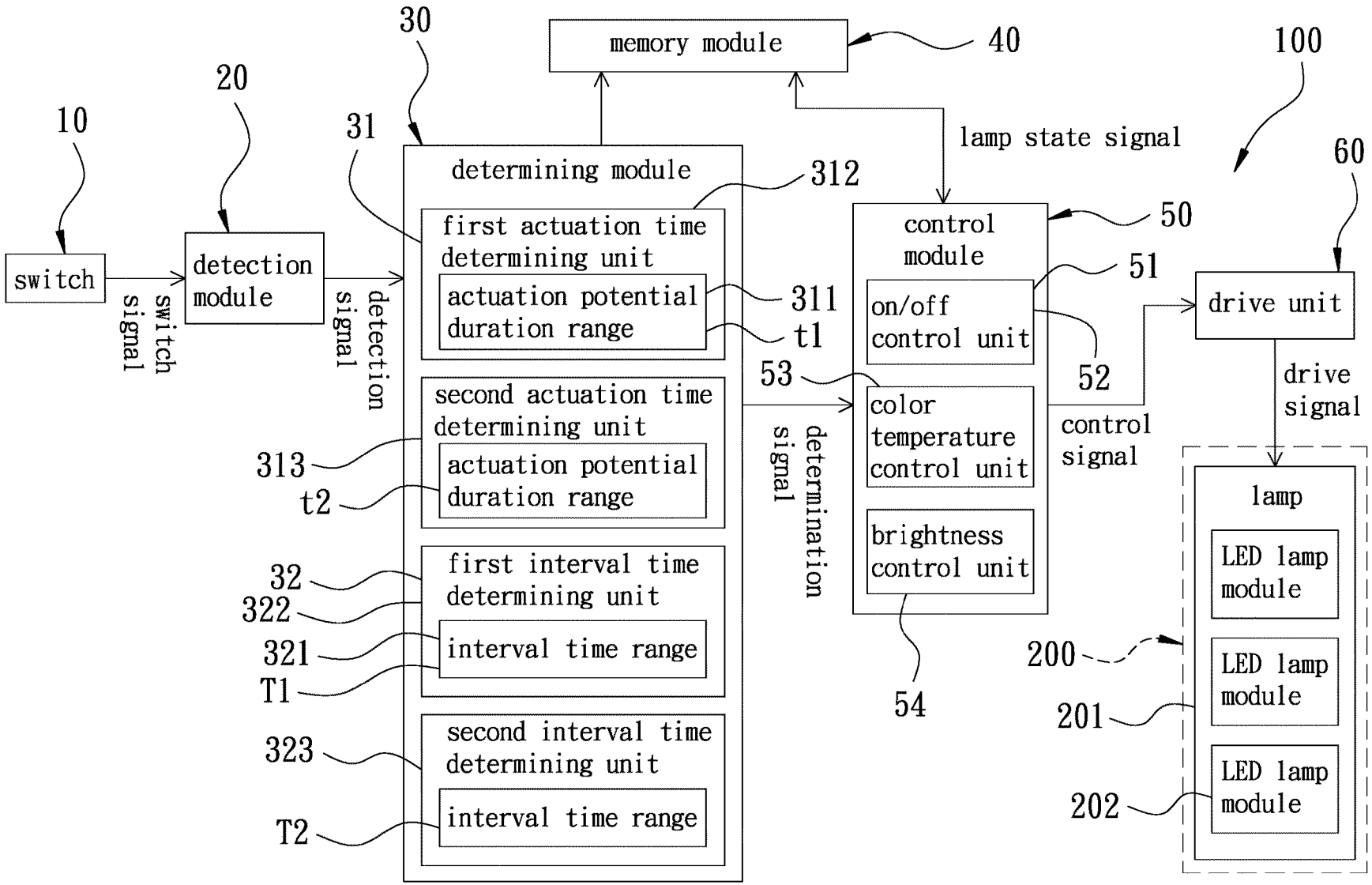
FIG. 5 is a block diagram of a second embodiment of the present invention.

FIG. 5 is a block diagram of a second embodiment of the present invention. The second embodiment is substantially similar to the first embodiment with the exceptions described hereinafter. The at least one interval time determining unit 32 further has two interval time determining units 32, defined as a first interval time determining unit 322 and a second interval time determining unit 323. The interval time ranges 321 of the interval time determining units 32 do not overlap with each other. The on/off control unit 52 outputs the control signal according to the comparison result of the first actuation time determining unit 312 and the second interval time determining unit 323 and the on/off state of the lamp of the memory module 40 for controlling the lamp 201 to be turned on/off. In the second embodiment of the present creation, the interval time range T2 of the second interval time determining unit 323 is 2 s<T2, where the unit of s is seconds.

Figure 6:
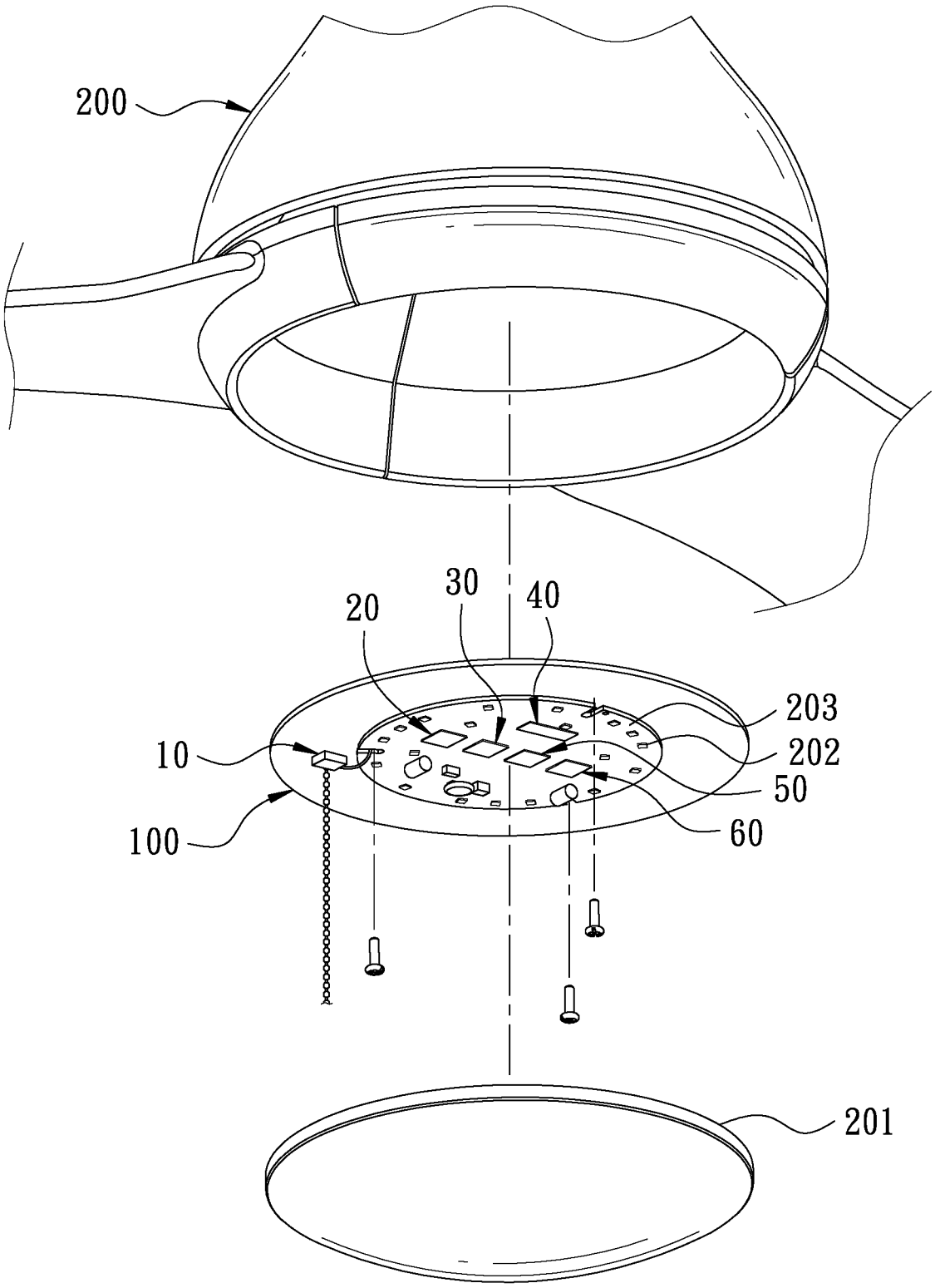
FIG. 6 is a schematic view of the present invention when in use.

Referring to FIG. 6, the lamp 201 includes a printed circuit board 203 therein. The LED lamp modules 202, the detection module 20, the determining module 30, the memory module 40, the control module 50, and the drive unit 60 are disposed on the printed circuit board 203, which is convenient for manufacture and installation.

Thereby, the color temperature and brightness control system 100 of the LED lamp of the present invention can controls the on/off, brightness and color temperature of the lamp through a single switch.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A color temperature and brightness control system for an LED lamp, applied to a ceiling fan, the ceiling fan having a lamp, the lamp being an LED lamp; the color temperature and brightness control system comprising:

a switch, having a switch signal, wherein when the switch is not actuated, the switch signal has a normal potential, when the switch is actuated, the switch signal has an actuation potential;

a detection module, electrically connected to the switch, the detection module receiving the switch signal and detecting a duration of the actuation potential and a duration of the normal potential of the switch signal to output a detection signal;

a determining module, configured to receive the detection signal and determines the duration of the actuation potential to output a determination signal;

a memory module, configured to memorize a state of the lamp, the memory module outputting a lamp state signal, the lamp state signal including the state of the lamp, the state of the lamp including an on/off state, a color temperature state and a brightness state of the lamp;

a control module, being in signal communication with the determining module, the control module receiving the determination signal, the determining module and the control module being in signal communication with the memory module for the memory module to store the state of the lamp so that the control module receives the lamp state signal, the control module outputting a control signal according to a calculation result of the determination signal and the lamp state signal; wherein the control signal is used for an on/off control, a color temperature control and a brightness control of the lamp; and a drive unit, electrically connected to the lamp and the control module, the drive unit receiving the control signal of the control module to output a drive signal for driving the lamp to be actuated, wherein the determining module further determines a combination of the duration of the actuation potential and the duration of the normal potential, the determining module has at least one actuation time determining unit and at least one interval time determining unit, the actuation time determining unit and the interval time determining unit of the determining module are in signal communication with the detection module and receive the detection signal, each actuation time determining unit presets an actuation potential duration range and compares the duration of the actuation potential with the actuation potential duration range of the actuation time determining unit, each interval time determining unit presets an interval time range and compares an interval time between two adjacent actuation potentials and the interval time range of the interval time determining unit, and the determination signal includes a comparison result of the actuation time determining unit of the determining module and a comparison result of the actuation time determining unit and the interval time determining unit.

2. The color temperature and brightness control system as claimed in claim 1, wherein the at least one actuation time determining unit has two actuation time determining units defined as a first actuation time determining unit and a second actuation time determining unit, and the actuation potential duration ranges of the actuation time determining units do not overlap with each other.

3. The color temperature and brightness control system as claimed in claim 2, wherein the at least one interval time determining unit has one interval time determining unit defined as a first interval time determining unit.

4. The color temperature and brightness control system as claimed in claim 3, wherein the control module has three control units defined as an on/off control unit, a color temperature control unit and a brightness control unit; the on/off control unit outputs the control signal according to a comparison result of the first actuation time determining unit and the on/off state of the lamp of the memory module for controlling the lamp to be turned on/off; the color temperature control unit outputs the control signal according to a comparison result of the first actuation time determining unit and the first interval time determining unit and the color temperature state of the lamp of the memory module for controlling a color temperature of the lamp; the brightness control unit outputs the control signal according to a comparison result of the second actuation time determining unit and the brightness state of the lamp of the memory module for controlling brightness of the lamp.

5. The color temperature and brightness control system as claimed in claim 4, wherein the lamp has at least two sets of LED lamp modules with different color temperatures, the color temperature control unit outputs the control signal to control each LED lamp module to be turned on/off for controlling the color temperature of the lamp, the interval time between the two adjacent actuation potentials is the sum of the duration of the two adjacent actuation potentials and the duration of the normal potential between the two adjacent actuation potentials, the lamp includes a printed circuit board therein, the LED lamp modules, the detection module, the determining module, the memory module, the control module and the drive unit are disposed on the printed circuit board.

6. The color temperature and brightness control system as claimed in claim 2, wherein the at least one interval time determining unit further has two interval time determining units defined as a first interval time determining unit and a second interval time determining unit, and the interval time ranges of the interval time determining units do not overlap with each other.

7. The color temperature and brightness control system as claimed in claim 6, wherein the control module has three control units defined as an on/off control unit, a color temperature control unit and a brightness control unit; the on/off control unit outputs the control signal according to a comparison result of the first actuation time determining unit and the second interval time determining unit and the on/off state of the lamp of the memory module for controlling the lamp to be turned on/off; the color temperature control unit outputs the control signal according to a comparison result of the first actuation time determining unit and the first interval time determining unit and the color temperature state of the lamp of the memory module for controlling a color temperature of the lamp; the brightness control unit outputs the control signal according to a comparison result of the second actuation time determining unit and the brightness state of the lamp of the memory module for controlling brightness of the lamp.

8. The color temperature and brightness control system as claimed in claim 7, wherein the lamp has at least two sets of LED lamp modules with different color temperatures, and the color temperature control unit outputs the control signal to control each LED lamp module to be turned on/off for controlling the color temperature of the lamp, the lamp includes a printed circuit board therein, the LED lamp modules, the detection module, the determining module, the memory module, the control module and the drive unit are disposed on the printed circuit board.

9. The color temperature and brightness control system as claimed in claim 1, wherein the switch is one of a normally open switch and a normally closed switch.

* * * * *